United States Patent [19]

Tatro

[11] Patent Number: 4,658,702

[45] Date of Patent: Apr. 21, 1987

[54] SAFETY DEVICE PREVENTING CONVERSION TO FULL AUTOMATIC FIRING

[75] Inventor: Henry J. Tatro, Westfield, Mass.

[73] Assignee: Colt Industries Inc., New York, N.Y.

[21] Appl. No.: 780,026

[22] Filed: Sep. 25, 1985

[51] Int. Cl.[4] ..... F41C 5/00; F41C 11/00; F41D 11/16

[52] U.S. Cl. ..... 89/139; 89/128; 42/16; 42/69.03

[58] Field of Search ..... 89/128, 139, 140; 42/16, 69.02, 69.03, 70.01, 70.08

[56] References Cited

U.S. PATENT DOCUMENTS 3,045,555 7/1962 Stoner ..... 89/142

3,670,442 6/1972 Kennedy et al. ..... 42/70.08

*Primary Examiner*—Deborah L. Kyle

*Assistant Examiner*—Ted L. Parr

*Attorney, Agent, or Firm*—Richard A. Dornon

[57] ABSTRACT

A firearm (10) adapted for blowback operation has a receiver incorporating a longitudinally reciprocatable bolt assembly (24) having an inertia firing pin (40) which is movable between retracted or recoil and battery positions in the receiver (14). A trigger (68), including a sear (72), is pivotally mounted in the receiver. A hammer (74) is pivotally mounted in the receiver in such a manner that movement of the bolt assembly from the battery position to the recoil position urges the hammer into a cocked position. The hammer includes a first sear abutment (82) to engage the sear on the trigger, a second sear abutment (84) and a stop abutment (86). A disconnector (76) is pivotally mounted on the trigger pin (70). The disconnector includes a hook sear abutment (88) on an intermediate portion which is adapted to engage the second sear abutment on the hammer when the trigger is in a depressed position. Should the disconnector or hook sear be removed from the firearm, the stop abutment on the hammer is adapted to engage an abutment surface (98) in bolt assembly during movement from the recoil position to the battery position for preventing the conversion of the firearm into a machine gun. Additional removal of the stop abutment from the hammer will not permit automatic operation since material (96,97) is provided in the bolt to prevent incorporation of a longer firing pin.

5 Claims, 8 Drawing Figures

SAFETY DEVICE PREVENTING CONVERSION TO FULL AUTOMATIC FIRING

TECHNICAL FIELD

The present invention relates to firearms, and more particularly to semiautomatic firearms. Even more particularly, the present invention relates to safety devices for semiautomatic firearms which are intended to prevent the conversion of the firearms into an automatic firearm.

BACKGROUND ART

Numerous semiautomatic firearms, known in the prior art, may be converted into fully automatic firearms by minor alterations and/or removal of the parts of the firing system. In many semiautomatic firearms, this conversion can be effected in a relatively short period of time.

U.S. Pat. No. 3,670,442 provides an arrangement for a semiautomatic firearm, whereby removal or alteration of the components of the firing mechanism thereof will not render the firearm automatic. The noted patent shows means which will automatically keep the firearm from being converted into a machine gun by the alteration and/or removal of existing parts.

The aforementioned Patent discloses a hammer including a stop abutment thereupon which is adapted, under certain conditions, to prevent the return of the bolt assembly to the battery position from the recoil position. Specifically, should the disconnector or hook sear be removed from the mechanism, the stop abutment will engage a surface on the bolt assembly during forward movement of the bolt assembly from its recoil position. Thus, even though the disconnector be removed, the mechanism will prevent a firearm, in which it is incorporated, from firing automatically due to the engaging contact between the stop abutment and the bolt assembly during forward movement of the bolt assembly. Although an arrangement similar to that shown in U.S. Pat. No. 3,670,442 is well suited to firearms adapted for blowback operations removal of the stop abutment on the hammer could possibly permit automatic operation.

DISCLOSURE OF THE INVENTION

In accordance with the invention, there is provided a semiautomatic firearm and means to preclude the conversion of the firearm into an automatic firearm. A firearm of the invention has a firing mechanism similar in design to that shown in the aforementioned patent but has a bolt assembly with an inertia firing pin adapted for blowback operation. The hammer of the firing mechanism includes a stop abutment which engages a surface on the bolt assembly during forward movement from its recoil position if the disconnector is removed or disabled. To further complicate conversion of a firearm of the invention to a fully automatic firearm, the bolt assembly is designed to prevent replacement of the firing pin with any pin longer than the original pin. Hence, should both the disconnector and the stop abutment be removed, a chambered cartridge cannot be fired because the hammer following the bolt assembly to its battery position will not have sufficient velocity to displace the firing pin into contact with the chambered cartridge and any attempt to install a longer firing pin whereby contact can be made with the cartridge will not succeed.

Accordingly, it is a primary object of the invention to provide a means for insuring that a semiautomatic firearm cannot be readily converted into an automatic firearm.

A further object is the provision, in a semiautomatic firearm having a trigger disconnector, hammer and bolt assembly, of a means to render the firearm inoperative should the disconnector be removed in an attempt to convert the semiautomatic firearm into an automatic firearm.

A still further object is to provide a firing mechanism, having a trigger, disconnector with a sear thereupon, hammer and blowback-operated bolt assembly, wherein the hammer is adapted to preclude forward movement of the bolt assembly into a battery position, should the disconnector be removed or the sear fail.

An even further object is the provision of a firing mechanism, including a hammer and a blowback-operated bolt assembly with an inertia firing pin in which the hammer and bolt assembly are respectively provided with abutments which are adapted to contact one another during forward movement of the bolt assembly into a battery position if an attempt is made to defeat the semiautomatic functioning of the firearm and to frustrate attempts to install a longer firing pin should one or both of the abutments be removed.

These and other objects and advantages of the invention will become apparent from the following detailed description of an exemplary embodiment of the invention taken in conjunction with the accompanying drawings.

BEST MODE OF CARRYING OUT THE INVENTION

Figure 1:
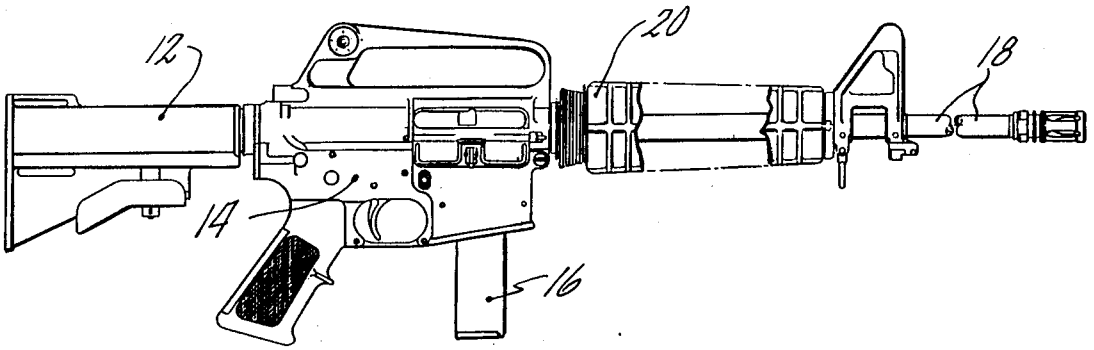
FIG. 1 is a side elevational view of a semiautomatic firearm incorporating a firing mechanism according to the invention.
Figure 2:
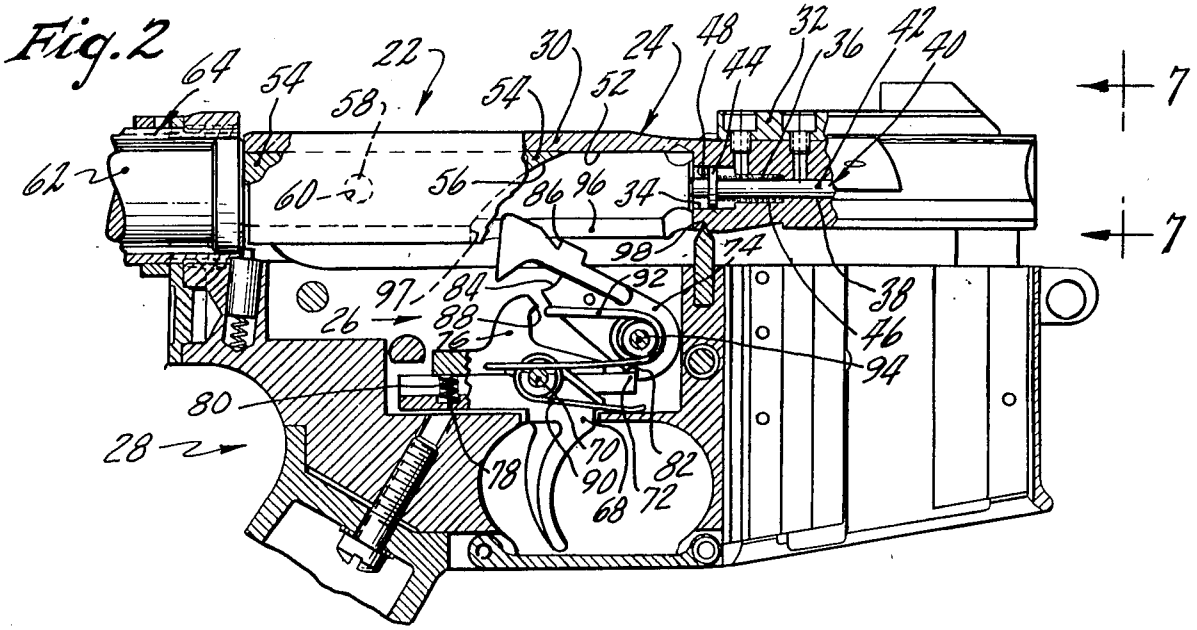
FIG. 2 is a fragmentary vertical sectional view of the receiver portion of the semiautomatic firearm of FIG. 1, in which the hammer is in cocked position.

Referring now to the drawings in greater detail, wherein like reference characters indicate like parts throughout the several figures, there is shown in FIG. 1 a firearm 19, which is a semiautomatic firearm. The firearm 10 includes a stock 12 mounted on a receiver 14, the receiver having a cartridge magazine 16 mounted therein. A barrel 18 is operatively connected to the receiver and has a hand grip 20 mounted thereupon for isolating the hand of a shooter from direct contact with the barrel. As shown in FIG. 2, the receiver 14 embodies a firing mechanism, generally indicated at 22, including a bolt assembly, generally indicated at 24 and a trigger mechanism, generally indicated at 26. The receiver 14 is composed of a lower receiver 28, housing the lockwork of the rifle, and an interconnected upper receiver (not shown in FIG. 2), which is provided with a longitudinal cavity or chamber, in which is mounted the bolt assembly 24 for reciprocating movement therein.

The bolt assembly is of the blowback type and comprises a bolt 30 and a bolt key 32 integral therewith and immovably connected thereto. The bolt 30 has three communicating longitudinal cylindrical bores therein 34, 36 and 38 which receive an inertia firing pin, generally shown at 40. Firing pin 40 comprises a shaft 42 mounted for sliding movement within the bore 38 and having an enlarged diameter portion 44 slidably mounted in the bore 34. A compression spring 46, surrounding the firing pin 40 in coaxial fashion, extends through the annular volume defined between the outer periphery of the firing pin 40 and the cylindrical wall of bore 36 and seats against the enlarged diameter portion 44 and the annular area at the base of passage 36. The spring 46 urges the firing pin 40 to the rear such that the enlarged diameter portion 44 engages a firing pin retaining pin 48 secured to the bolt 30. When the bolt assembly 24 occupies its battery position in the forward extremity of the upper receiver (not shown) and firing pin 40 is struck upon its rear extremity, the firing pin 40 is adapted to be displaced forwardly, against the bias of the spring 46, such that its tip engages and fires a chambered cartridge.

The bolt 30 embodies a cavity 52 in its rear portion to allow for machining of the bores in which the firing pin is mounted and to permit hammer rotation. Inserted in the cavity 52 is a plug 54 having a sloping forward wall 56. Plug 54 is secured to the bolt carrier by means of a pin 58 press fitted into a hole 60 in the plug 54. The wall 56 of the plug permits removal and replacement of the firing pin 40 and allows for hammer rotation. The rear extremity of the bolt assembly 24 is in abutting contact with a buffer 62 (partially shown), housed in a receiver extension 64 which is threadably secured to the receiver 14.

Upon firing the firearm illustrated in FIG. 1, the bullet passes outwardly through the barrel 18 under the impetus of the expanding powder gases. The weight of the bolt assembly 24 and the buffer 62 will cause sufficient delay in extracting the empty cartridge case so as not to cause the cartridge case to rupture. The empty cartridge case imparts a rearward momentum to the bolt assembly 24 which is absorbed by the compression of an operating spring (not shown) until the bolt assembly has reached its recoil or retracted position. During the recoil stroke the empty cartridge case will be retained in engagement with the bolt assembly by the usual cartridge extractor 66 (FIG. 8) until striking a fixed ejector (not shown) in the usual manner whereupon the case will be expelled from the receiver. Upon dissipation of the rearward momentum of the bolt assembly 24, the operating spring acting upon the buffer 62 returns the bolt assembly to the battery position which stripping a fresh cartridge from the magazine 16 during the counter recoil stroke and chambers the stripped cartridge in the barrel 18.

The trigger mechanism 26 is similar in design and operation to that mechanism described in U.S. Pat. Nos. 3,045,555 and 3,670,442 and of course, is designed to furnish only semiautomatic operation of the firearm 10. The trigger mechanism 26 comprises a trigger 68 which is pivotally mounted within the lower receiver section 28 by transversely oriented pivot pin 70. Trigger 68 has an elongated upper portion which includes a forward trigger sear 72 adapted, in a manner hereinafter described, to retain a hammer 74. Additionally mounted on the pivot pin 70 is a disconnector 76, the lower portion of which is located within a groove 78 in the upper portion of the trigger 68. A compression spring 80 is interposed between the bottom of the groove and the under side of the disconnector 76 in order to urge the disconnector in a clockwise direction about pivot pin 70.

The hammer 74 is provided with a first sear abutment 82 in the forward portion thereof and a second sear abutment 84 in the intermediate portion thereof. The hammer 74 is also provided with a bolt stop abutment 86 adjacent the face thereof which is adapted to engage the bolt assembly 24 in a manner hereinafter described.

The disconnector 76 includes a vertically extending portion which incorporates a hook sear abutment 88. The trigger 68, by virtue of its pivotal mounting on pin 70, is adapted to pivot from a first position, in which the sear 72 thereof engages the first sear abutment 82 of the hammer 74, to a second position angularly spaced in a clockwise manner from the first position, in which the hook sear abutment 88 on the disconnector 76 engages the second abutment 84 of the hammer 74. The hammer 74 is maintained in a cocked nonfiring position by the cooperative interengagement between either the trigger sear 72 and the first sear abutment 82 or the hook sear abutment and the second sear abutment, the interengagements being respectively maintained by the bias of a trigger spring 90 and the pressure of the shooter's finger.

Upon rearward pivotal movement of the trigger 68 about its pivot pin 70 against the bias of the trigger spring 90, the hammer 74 swings upwardly under the bias of a hammer spring 92 about its mounting pivot 94. During upward swinging between a cocked position and a firing position, in which it contacts the firing pin 40, the hammer passes through a bottom longitudinal aperture or slot 96 formed in the lower portion of the bolt 30 and having a base or terminus 97. Upon striking the firing pin 40, a chambered cartridge is fired from the barrel 18. When the bolt assembly 24 recoils the hammer 74 is urged by the carrier 32 in a downward or counterclockwise direction. Assuming that the trigger 68 is retained in its depressed or second position during this downward movement of the hammer 74, the second sear abutment 84 of the hammer 74 will engage the hook sear abutment 88 of the disconnector 76 after slightly displacing the disconnector in a counter-clockwise direction about the pivot 70. Conversely, if the trigger 68 is immediately returned to its first position after the firing of the chambered cartridge, the hammer 74 will be retained in its cocked position by the engagement of the trigger sear 72 and the first sear abutment 82. Normally, the trigger will be momentarily retained in its second position after the weapon has been fired, and thus the recoil of the bolt assembly 24 normally causes the second sear abutment 84 to engage hook sear abutment 88. When the trigger is released after this engagement has been effected, the trigger sear 72 will move into engagement with the first sear abutment 82 after the second sear abutment 84 and the hook sear abutment 88 move out of engagement. After this occurs, the mechanism is poised to fire another cartridge.

The bolt 30 of the instant invention incorporates an abutment surface 98 adapted to contact the bolt stop abutment 86 on the hammer. If the second sear abutment 84 and the hook sear abutment 88 fail to engage one another due to the removal, alteration or breakage of abutment 88 or abutment 84, or the complete removal of the disconnector 76 from the mechanism, it can be seen, in FIG. 2, that the stop abutment 86 will engage the abutment surface 98 during counter recoil of bolt assembly 24.

Figure 3:
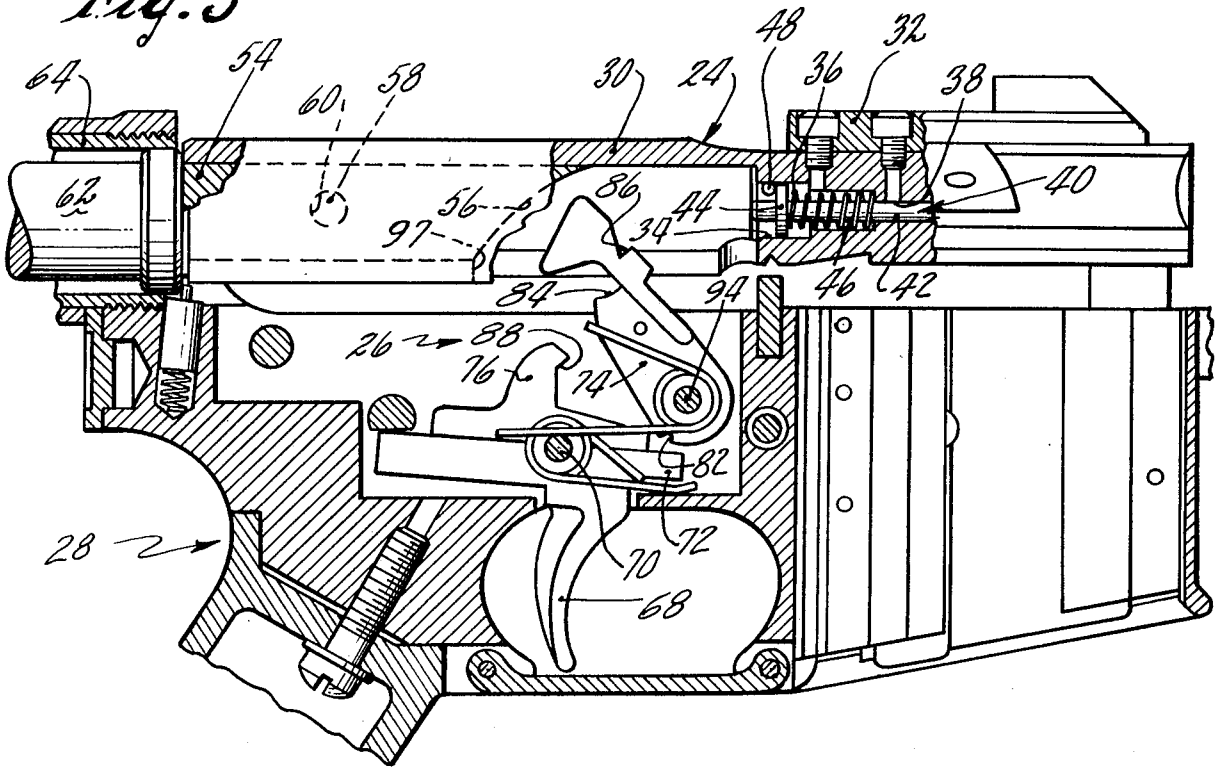
FIG. 3 is a fragmentary vertical sectional view showing the hammer rotating toward the firing pin.

Various configurations, which the firing mechanism may assume, are shown in FIGS. 2 through 6. Referring to FIG. 3, the hammer 74 is shown rotating towards its firing position where it will strike the firing pin 40 and fire a chambered cartridge from the barrel 18. It will be noted that immediately after firing a cartridge, an operator of the firearm will normally maintain the trigger 68 in its second position which is therein illustrated.

Figure 4:
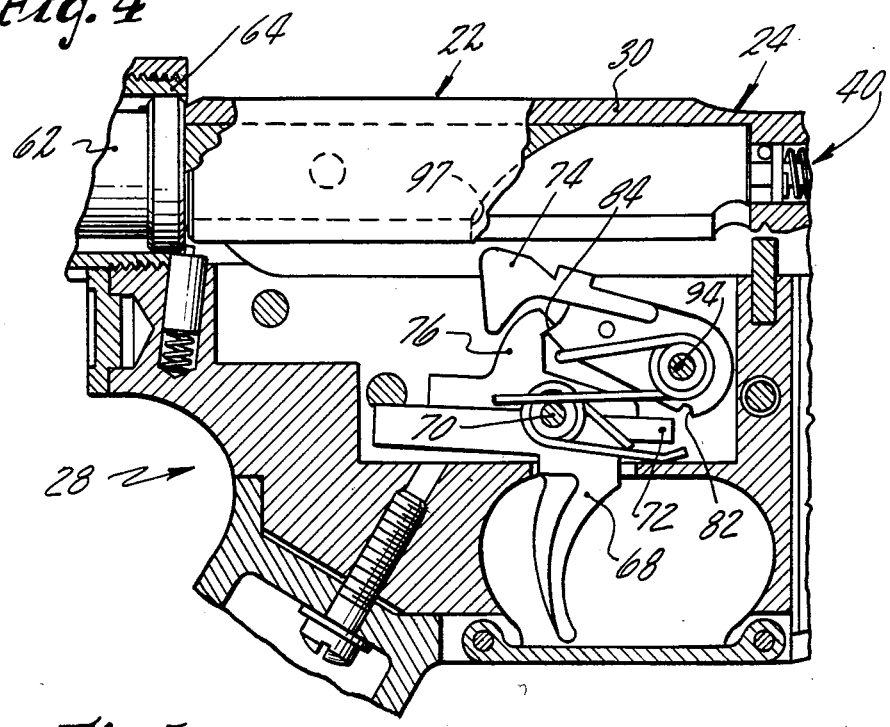
FIG. 4 is a fragmentary vertical sectional view showing the components of the firing mechanism when the bolt assembly has returned the hammer to a cocked position and the trigger is depressed.

Turning now to FIG. 4, it will be noted that the hammer 74 has been urged into engaging contact with the disconnector 76 by the recoil of the bolt assembly 24, the trigger 68 being retained in its second or depressed position. In this configuration, the hammer 74 is prevented from swinging upwardly to strike the firing pin by the contact between the second sear abutment 84 and the hook sear abutment 88. It should be readily apparent that if the trigger mechanism 26 were modified so that the abutments could not engage one another, the hammer 62 would again strike the firing pin 38 upon forward movement of the bolt assembly were it not for the abutment surface 98.

When the trigger 56 is released from its second position, illustrated in FIG. 4, the abutments 84 and 88 move out of engagement by virtue of the pivoting of trigger 68 under the bias of trigger spring 90; and the trigger sear 72 and the first sear abutment 82 of the hammer 74 move into engaging contact to retain the hammer 74 in a cocked configuration, as shown in FIG. 2. It will be noted, that, with reference to FIG. 2, the trigger 68 is in its first position. In this configuration, depression of the trigger 68 results in disengagement between the trigger sear 72 and the first sear abutment 82, thereby permitting the hammer 74 to swing upwardly in a clockwise fashion and strike the firing pin 40.

Figure 5:
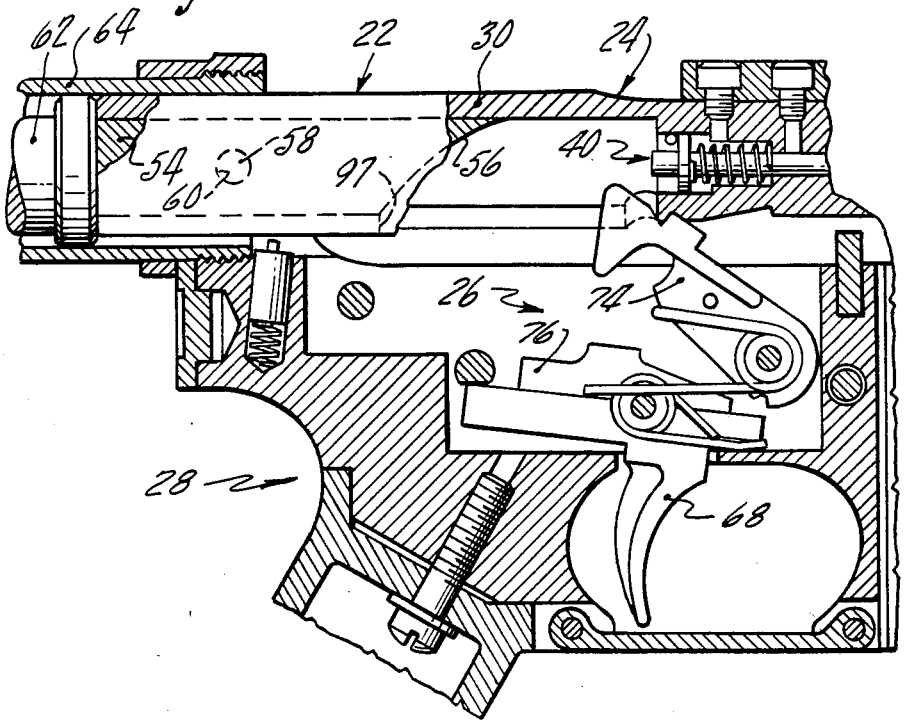
FIG. 5 is a fragmentary vertical sectional view illustrating the engagement between the bolt assembly and the hammer occasioned during the movement of the bolt assembly from the recoil to the battery position when the hook sear of the disconnector is removed in an attempt to make the firearm automatic.
Figure 6:
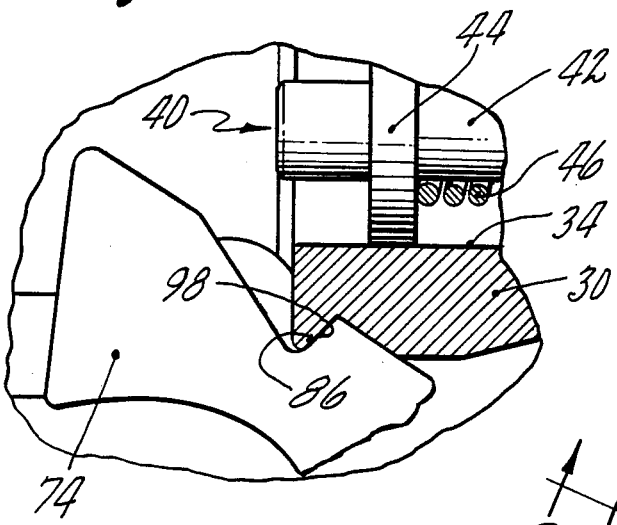
FIG. 6 is an enlarged view of the area of engagement between the hammer and the bolt assembly as shown in FIG. 5.
Figure 7:
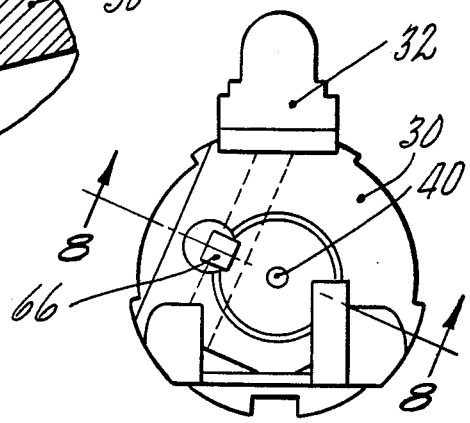
FIG. 7 is a front elevational view of the bolt assembly, per se, taken substantially along the line 7—7 of FIG. 2.

FIG. 5 and 6 show the trigger mechanism of FIGS. 2-4, wherein the hook sear abutment 88 of the disconnector 76 has been completely removed in an attempt to convert the semiautomatic firearm into an automatic firearm or machine gun. As FIG. 5 and 6 show, this modification will not defeat the semiautomatic nature of the firearm as the bolt stop abutment 86 will engage the abutment surface 98, thereby preventing completion of the counter recoil movement of the bolt assembly from the recoil position to the battery position.

Figure 8:
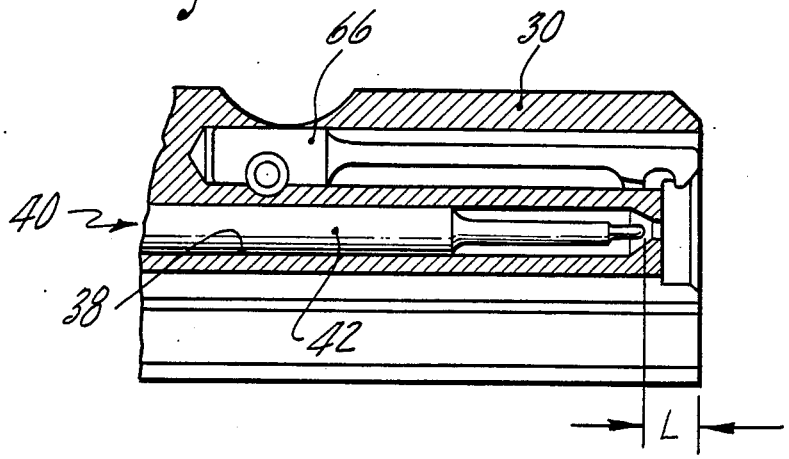
FIG. 8 is a fragmentary sectional view of the bolt assembly taken substantially along the line 8—8 of FIG. 7.

Any attempt to defeat the conversion prevention feature aforedescribed by removing either the bolt stop abutment 86 from the hammer 74 or the abutment surface 98 from the bolt 30 or both will be unsuccessful since the hammer 74 will not attain sufficient velocity as it moves with the bolt assembly to enable it to displace the firing pin 40 such that it may fire a chambered cartridge. Moreover, the installation of a longer firing pin in an effort to achieve automatic operation is similarly condemned to failure because of the length of the slot 96 in bolt 30. As shown in FIG. 8, it is necessary that firing pin 40 be lengthened (e.g., by the amount designated L in FIG. 8) whereby it might be possible to attain slam fire automatic operation. In addition, removal of the plug 54 in order to install a longer firing pin is prevented by the fact that the hole 60 extends through only one side of the bolt and pin 58 is too long to be driven into the center of the plug 54.

As will be apparent to those skilled in the art, further modifications and adaptions of the above-described structure are possible without departure from the spirit and scope of the invention as defined in the appended claims.

What I claim is:

1. In a firing mechanism of the type having a receiver; a bolt assembly mounted for longitudinal movement in the receiver between recoil and battery positions; a hammer pivotally mounted in the receiver such that movement of the bolt assembly from the battery position to the recoil position urges the hammer into a cocked position; a firing pin slidably mounted in the bolt assembly adapted to be displaced into engagement with a cartridge upon being struck by the face of the hammer; and means to prevent movement of the bolt assembly from the recoil position to the battery position when the hammer is not retained in the cocked position, the improvement comprising:

means to prevent replacing the firing pin with a longer firing pin.

2. The improvement of claim 1, wherein the bolt assembly includes a bolt, the firing pin being mounted in the bolt and wherein the movement preventing means comprises:

a stop abutment on the face of the hammer; and an abutment surface on the bolt, the surface being engageable by the stop abutment during movement of the bolt assembly from the recoil position to the battery position.

3. The improvement of claim 1, wherein the firing mechanism is of the type further including:

a trigger having a sear abutment thereupon pivotally mounted in the receiver;

a disconnector having a hook sear abutment thereupon operatively connected to the trigger;

a first sear abutment on the hammer for engagement by the sear abutment on the trigger to retain the hammer in the cocked position; and a second sear abutment on the hammer for engagement by the hook sear abutment when the trigger is depressed to retain the hammer in the cocked position.

4. The improvement of claim 1, wherein the bolt assembly is blowback-operated and wherein there is further provided:

means to urge the firing pin towards the rear of the bolt assembly.

5. The improvement of claim 4, wherein the bolt assembly includes a bolt, the bolt having a cavity in its rear portion and a slot in its lower portion, and wherein the replacement preventing means comprises:

a plug of material inserted in the cavity and the base of the slot.

* * * * *